US006261759B1

(12) United States Patent
Lok

(10) Patent No.: US 6,261,759 B1
(45) **Date of Patent: *Jul. 17, 2001**

(54) SILVER HALIDE EMULSIONS WITH REDUCED WET ABRASION SENSITIVITY

(75) Inventor: Roger Lok, Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,787

(22) Filed: Oct. 8, 1999

(51) Int. Cl.[7] ..... G03C 1/10
(52) U.S. Cl. ..... 430/611; 430/613
(58) Field of Search ..... 430/611, 613

(56) References Cited

U.S. PATENT DOCUMENTS

| | | | |
|---|---|---|---|
| 4,962,016 | 10/1990 | Chino et al. . | |
| 5,116,723 | 5/1992 | Kajiwara et al. . | |
| 5,670,307 | 9/1997 | Lok . | |
| 5,677,119 | 10/1997 | Lok . | |
| 5,693,460 | 12/1997 | Lok . | |
| 5,756,278 | 5/1998 | Lok . | |
| 5,914,226 * | 6/1999 | Lok | 430/611 |

* cited by examiner

*Primary Examiner*—Hoa Van Le
(74) *Attorney, Agent, or Firm*—Sarah Meeks Roberts

(57) ABSTRACT

This invention relates to a silver halide photographic element comprising a silver halide emulsion which is greater than 50 mole % silver chloride and (a) which has been chemically sensitized in the presence of a dithiolone compound represented by Formula (A):

(A)

wherein b is C(O), C(S), C(Se), $CH_2$ or $(CH_2)_2$, and $R^1$ and $R^2$ are substituents or wherein $R^1$ and $R^2$ may together represent the atoms necessary to form a substituted or unsubstituted five or six-membered ring or a multiple ring system; and q is 1 or 2; and a fist mercapto azole compound independently represented by Formula B:

(B)

wherein Q represents the atoms necessary to form a substituted or unsubstituted five or six -membered heterocyclic ring containing at least one nitrogen atom, and M is a cation; and (b) to which a second mercapto azole compound independently represented by Formula (B) was added after the completion of chemical sensitization.

10 Claims, No Drawings

SILVER HALIDE EMULSIONS WITH REDUCED WET ABRASION SENSITIVITY

FIELD OF THE INVENTION

The invention relates silver halide photographic elements comprising high chloride emulsions containing specific dithiolone compounds in combination with specific mercapto azole compounds, and methods of preparing such emulsions.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions. The chemicals used for preventing fog growth as a result of aging or storage are generally known as emulsion stabilizers.

The control of fog, whether occurring during the formation of the light-sensitive silver halide emulsion, during the spectral/chemical sensitization of those emulsions, during the preparation of silver halide compositions prior to coating on an appropriate support, or during the aging of such coated silver halide compositions, has been attempted by a variety of means. Mercury-containing compounds, such as those described in U.S. Pat. Nos. 2,728,663; 2,728,664; and 2,728,665, have been used as additives to control fog. Thiosulfonates and thiosulfonate esters, such as those described in U.S. Pat. Nos. 2,440,206; 2,934,198; 3,047,393; and 4,960,689, have also been employed. Organic dichalcogenides, for example, the disulfide compounds described in U.S. Pat. Nos. 1,962,133; 2,465,149; 2,756,145; 2,935,404; 3,184,313; 3, 318,701; 3,409,437; 3,447,925; 4,243,748; 4,463,082; and 4,788,132 have been used not only to prevent formation of fog but also as desensitizers and as agents in processing baths and as additives in diffusion transfer systems. Organic compounds having a polysulfur linkage comprised of three or more sulfur atoms, and organic compounds having a heterocyclic ring having at least two thioether linkages or at least one disulfur linkage, such as those described in U.S. Pat. No. 5,116,723, in combination with nitrogen-containing cyclic compounds have also been discussed as suppressing fog and improving raw stock stability.

Recently, a class of compounds has been reported to have benefits in stabilizing silver halide emulsions against such changes due to storage at high temperature and humidity. This class of sulfur heterocycle are compounds in which one of the two sulfur atoms in a five-membered heterocyclic ring is oxidized either to the tetravalent state (dithiolone dioxide) or to the trivalent state (dithiolone oxide). U.S. Pat. No. 5,693,460 teaches the stabilizing properties of dithiol-3-one 1,1-dioxides. U.S. Pat. No. 5,670,307 describes the combination of dithiol-3-one 1,1-dioxides with sulfinates. U.S. Pat. No. 5,756,278 relates to the combination of water soluble gold sensitizers with dithiolone dioxide compounds for enhanced emulsion sensitivity. U.S. Pat. No. 5,677,119 describes the stabilizing properties of dithiol-3-one 1-oxide in silver halide light sensitive materials.

Another type of fogging may also occur in a photographic element. When pressure is applied to a silver halide photographic print during wet processing it may cause an unwanted plus or minus density mark in the exposed region of the color print. This problem is known as Wet Abrasion Sensitivity (WAS) and is particularly acute for the magenta layer of the photographic element. The problem may be exacerbated when certain mercapto azole compounds are used as addenda in the photographic element. Removal of the mercapto azole compounds has been suggested as a method to minimize WAS; but mercapto azoles provide a variety of benefits such as the minimization of "magenta dye streaking", antifogging, emulsion stabilizing and development modifying and it is therefore desirable to continue using these compounds. Such compounds are well known in the art and examples of their use are given in "Stabilization of Photographic Silver Halide Emulsions" by E. J. Birr Focal Press, London and New York 1974. Generally mercapto azole compounds are added as addenda after chemical sensitization is complete.

U.S. Pat. No. 4,962,016 describes a photographic element which has high sensitivity and excellent pressure resistance. This is achieved by utilizing a photographic component layer with a certain degree of swelling and which contains elemental sulfur. The photographic element may also contain certain mercaptoazoles, which are preferably added during the coating solution preparing step. It has been discovered by the inventors herein, however, that the addition of mercapto azole compounds solely after chemical sensitization results in poor WAS performance.

There is a continuing need for photographic elements that are not prone to the WAS that causes deterioration of the print by pressure applied during development. There is a further need for the correction of this problem without generating speed losses in the photographic element or creating stability problems either in the melts prior to the formation of the photographic element or in the photographic element during storage prior to exposure.

SUMMARY OF THE INVENTION

This invention provides a silver halide photographic element comprising a silver halide emulsion which is greater than 50 mole % silver chloride and (a) which has been chemically sensitized in the presence of a dithiolone compound represented by Formula (A):

(A)

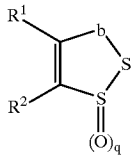

wherein b is C(O), C(S), C(Se), $CH_2$ or $(CH)_2$, and $R^1$ and $R^2$ are independently substituents, preferably H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a substituted or unsubstituted five or six-membered ring or a multiple ring system; and q is 1 or 2; and a first mercapto azole compound independently represented by Formula B:

(B)

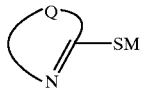

wherein Q represents the atoms necessary to form a substituted or unsubstituted five or six-membered heterocyclic ring containing at least one nitrogen atom, and M is a cation; and (b) to which a second mercapto azole compound independently represented by Formula (B) was added after the completion of chemical sensitization. This invention further provides methods of making silver halide emulsions contained in the above photographic element.

This invention provides a photographic element that has reduced sensitivity to abrasion in the wet state. The photographic element further exhibits high emulsion sensitivity and excellent storage properties, particularly during high temperature storage.

DETAILS OF THE INVENTION

The dithiolone compounds of the invention are represented by the following Formula A:

(A)

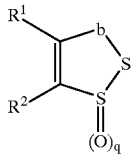

which includes both dithiolone 1,1-dioxide (where q=2) and dithiolone I-oxide (where q=1). b is C(O), C(S), C(Se), $CH_2$ or $(CH)_2$. More preferably b is C(O), C(S) or C(Se) and most preferably b is C(O).

$R^1$ and $R^2$ can be independently any substituents which are suitable for use in a silver halide photographic element and which do not interfere with the stabilizing activity of the dithiolone 1-oxide compound. $R^1$ and $R^2$ may be independently H, or a substituted or unsubstituted aliphatic, aromatic, or heterocyclic group or $R^1$ and $R^2$ may together represent the atoms necessary to form a ring or a multiple ring system. $R^1$ and $R^2$ may also be, for example, alkoxy groups (for example, methoxy, ethoxy, octyloxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acyloxy groups (for example, acetoxy, benzoxy), carboxyl groups, cyano groups, sulfo groups, amino groups, carbonamido groups, sulfonamido groups, cycloalkyl groups, cycloalkenyl groups, alkinyl groups, sulfnyl groups, phosphonyl groups, carbamoyl groups, sulfamoyl groups, alkylamino groups, anilino groups, imido groups, ureido groups, sulfamoylamino groups, alkoxycarbonylamino groups, aryloxycarbonyl-amino groups, alkoxycarbonyl groups, aryloxycarbonyl groups; siloxy groups, or carbamoyloxy groups.

When $R^1$ and $R^2$ are aliphatic groups, preferably, they are alkyl groups having from 1 to 22 carbon atoms, or alkenyl or alkynyl groups having from 2 to 22 carbon atoms. More preferably, they are alkyl groups having 1 to 8 carbon atoms, or alkenyl or alkynyl groups having 3 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms More preferably, the aromatic groups have 6 to I 0 carbon atoms and include, among others, phenyl and naphthyl groups. These groups may have substituent groups. The heterocyclic groups are 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Preferably, $R^1$ and $R^2$ together form a ring or multiple ring system. These ring systems may be unsubstituted or substituted. The ring and multiple ring systems formed by $R^1$ and $R^2$ may be alicyclic or they may be the aromatic and heterocyclic groups described above. In a preferred embodiment, $R^1$ and $R^2$ together form a 5 or 6-membered ring, preferably, an aromatic ring. In one particularly preferred embodiment b is C(O) and $R^1$ and $R^2$ together form a 5 or 6-membered ring. Most preferably, the dithiolone compound is 3H-1,2-benzodithiol-3-one 1-oxide or 3H-1,2-benzodithiol-3-one 1,1-dioxide.

Nonlimiting examples of substituent groups for $R^1$ and $R^2$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, a ryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro). Specific examples of the dithiolic compounds where q =2 include, include but are not limited to:

1
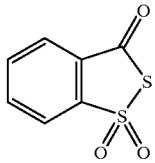
2
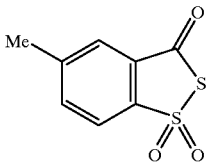
3
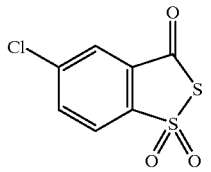
4
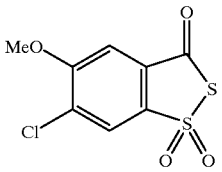
5
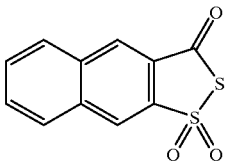
6
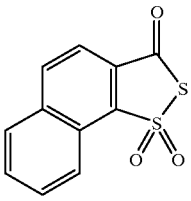
7
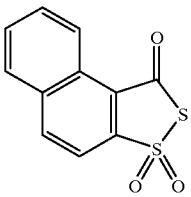
8
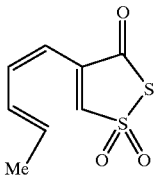
-continued
9
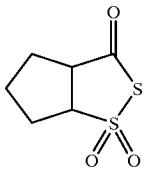
10
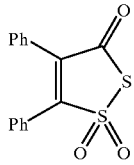
11
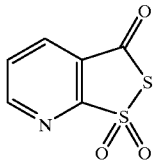
12
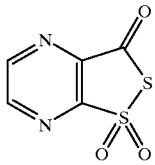
13
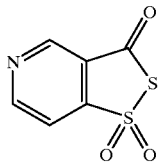
14
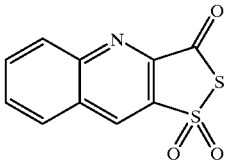
15
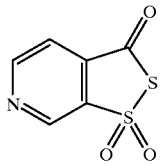
16
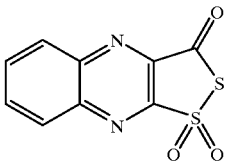
17
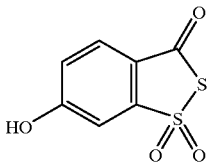

-continued
18
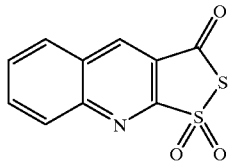
19
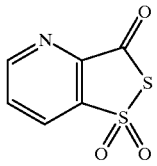
20
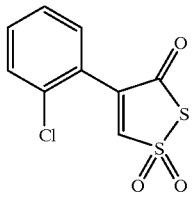
21
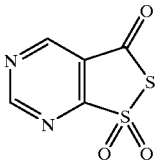
22
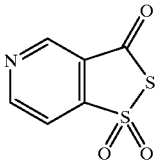
23
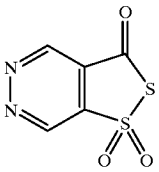
24
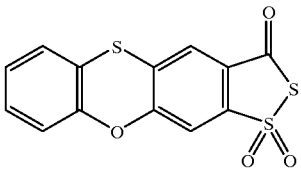
25
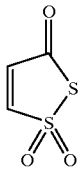
-continued
26
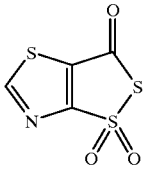
27
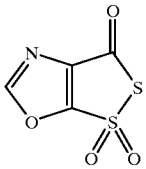
28
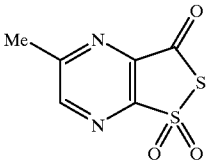
29
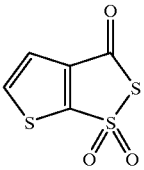
30
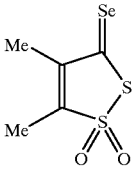
Specific examples of the dithiolic compounds where q=1 include, but are not limited to:
31
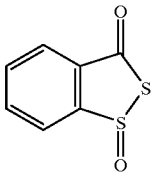
32
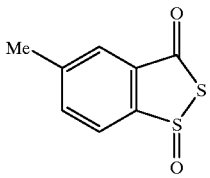
33
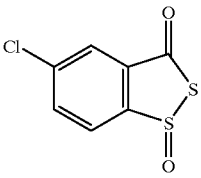

-continued
34
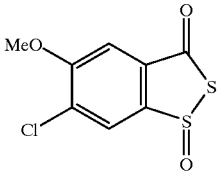
35
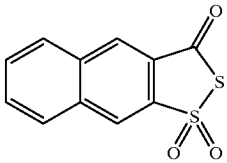
36
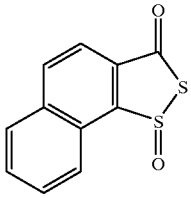
37
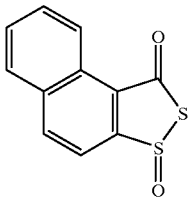
38
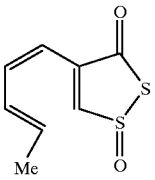
39
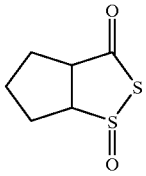
40
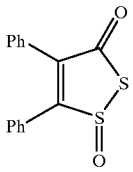
41
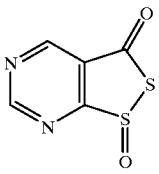
-continued
42
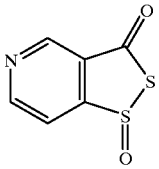
43
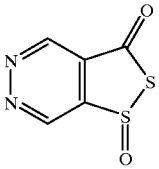
44
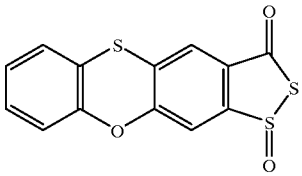
45
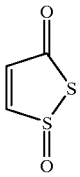
46
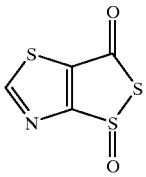
47
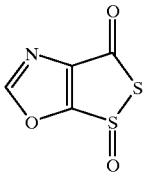
48
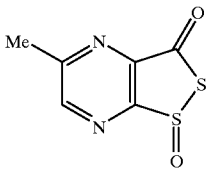
49
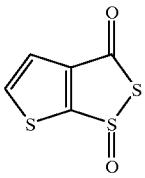

-continued

50

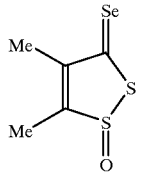

51

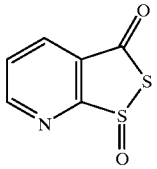

52

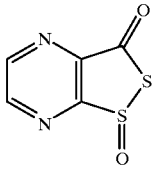

53

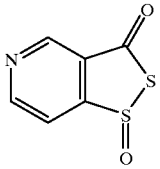

54

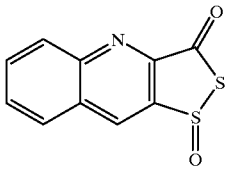

55

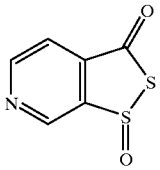

56

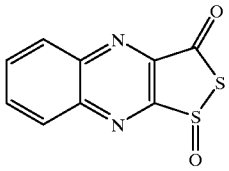

57

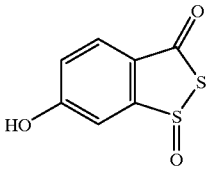

-continued

58

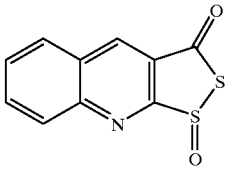

59

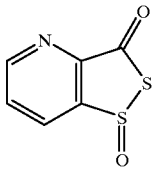

60

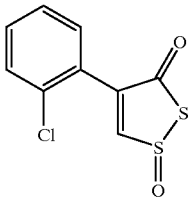

The mercapto azole compounds utilized in this invention are represented by Formula (B):

(B)

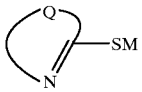

wherein Q represents the atoms necessary to complete a substituted or unsubstituted five or six-membered heterocyclic ring containing at least one heteroatom which is a nitrogen. M is a cation which may be hydrogen, a mono valent alkali metal cation or a tetrasubstituted ammonium cation. Preferred heterocyclic nuclei include tetrazoles, triazoles, imidazoles, oxadiazoles, thiadiazoles and benzothiazoles. Examples of suitable classes of compounds are shown below:

BI

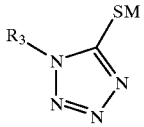

BII

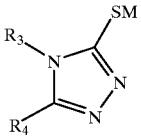

BIII

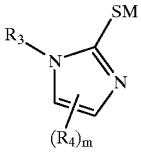

-continued

BIV

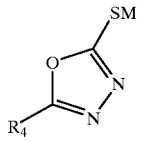

BV

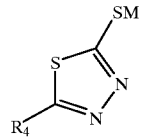

BVI

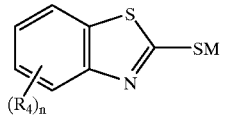

In the above examples M is an alkali metal cation or a tetrasubstituted ammonium cation. $R_3$is selected from hydrogen or alky aryl, carbonamido, sulfonamido, alkenyl, cycloalkyl, cycloalkenyl, alkinyl, sulfonyl, sulfnyl, phosphonyl, acyl, carbamoyl, sulfamoyl, amino, alkylamino, anilino, imido, ureido, sulfamoylamino, alkoxycarbonylamino, aryloxycarbonyl-amino, alkoxycarbonyl, and aryloxycarbonyl groups. $R_4$ is selected from the same substituents as $R_3$ and halogen, alkoxy, aryloxy, siloxy, acyloxy, or carbamoyloxy groups. m is 0, 1, or 2 and n is 0, 1, 2, 3 or 4. Preferably M is selected from Na or K.

In a preferred embodiment, the compound is the Na salt of a derivative of mercaptotetrazole, Bl. In a more preferred embodiment, the compound is the Na salt of a derivative of mercaptotetrazole, Bl wherein R3 is selected from a alky, aryl, alkylcarbonamidoaryl, or arylcarbonamidoaryl group. In the most preferred embodiment, $R_3$ is acetamidophenyl and M is Na (Bli).

Bli

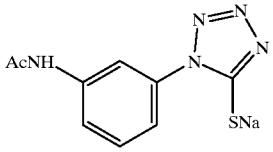

One method of preparing an aromatic 3H-1,2-dithiol-3-one 1,1-dioxide is via the cyclization of an ortho substituted aryl mercaptocarboxylic acid in the presence of thiolacetic acid. This is followed by oxidation of the product dithiolone with hydrogen peroxide in trifluroacetic acid described in *OPPI Bries* 24, #4,488 (1992). Alternatively, this class of compounds may be purchased commercially. One method of preparing an aromatic 3H-1,2-dithiol-3-one 1-oxide is via the cyclization of 2-thiolbenzoic acid in concentrated sulfuric acid and thiolacetic acid. This is followed by oxidation of the product with hydrogen peroxide in glacial acetic acid as described in *J Org. Chem.* 55, #15, 4699 (1990).

Compounds of general formula Bl can be made as described in, for example, U.S. Pat. Nos. 2,403,927; 3,266,897 ; 3,397,987; 3,364,028; 3,708,303; 4,804,623; Research Disclosure, Vol. 116, December 1973, Item 11684; and EP 330,018 and EP 564,281.

Useful levels of the dithiolone oxides may range from 0.001 mg to 1000 mg per silver mole. Preferably, the range is from 0.01 mg to 500 mg per silver mole. A more preferred range is from 0.1 mg to 100 mg per silver mole. The most preferred range is from 0.5 mg to 50 mg/Ag mole.

Useful levels of the mercapto azole may range from 0.01 mg to 10,000 mg per silver mole. Preferably, the range is from 0.1 mg to 1,000 mg per silver mole. A more preferred range is from 1 mg to 750 mg per silver mole. The most preferred range is from 10 mg to 500 mg/Ag mole. The range of mercapto azole to be added before chemical sensitization may vary between 1–90%. The preferred range is 5–50%, and the most preferred range is from 10–30%.

The dithiolone oxide compounds may be added as an acetone solution or in gelatin dispersions. Methanol solutions, however, are to be specifically avoided because of the propensity of this class of compound to decompose in organic hydroxylic solvents.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which ate designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The dithiolone compounds may be added to the silver halide emulsion at any time during the preparation of the emulsion whereby the emulsion will be chemically sensitized in the presence of the dithiolone compounds. They may be added anytime before or during precipitation and may be added by any technique suitable for this purpose. For example they may be added to the vessel containing the aqueous gelatin and salt solution before the start of the precipitation; they may also be added during precipitation to the salt solution, the silver nitrate solution, or from a separate jet directly into the kettle. They may also be added at any step after precipitation up to and during the heat treatment employed to effect chemical sensitization. More preferably, these compounds are added during chemical sensitization.

The mercapto azole compounds, which may be the same or different compounds, are added at two different times during the preparation of the emulsion. The first mercapto azole is added as described above for the dithiolone compound, that is it may be added to the silver halide emulsion at any time during the preparation of the emulsion whereby the emulsion will be chemically sensitized in the presence of the first mercapto azole compound. The second mercapto azole compound is added after completion of chemical sensitization i.e. after the heat treatment employed to effect the chemical sensitization up to the time of coating the emulsion on a support.

It is preferred that the first mercapto azole compound and dithiolone compounds be added separately. It is more preferred that the dithiolone compound be added prior to the mercapto azole. It is most preferred that the mercapto azole be added just before the heat rise, but after the introduction of the dithiolone compounds.

The dithiolone and mercapto azole compounds may be used in addition to any conventional emulsion stabilizers or antifoggant as commonly practiced in the art. Combinations of more than one dithiolone compound or one mercapto azole compound may be utilized.

The silver halide emulsions utilized in this invention are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic emulsions incorporating the stabilizers may be incorporated into color negative ( particularly color paper) or reversal photographic elements. The photographic element may also comprise a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published March 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, and *Research Disclosure,* September 1997, Item 40145, both published by Kenneth Mason Publications, Ltd., Dudley Annex, 12a North Street, Emsworth, Hampshire PO 10 7DQ, ENGLAND, the disclosures of which are incorporated herein by reference. The high chloride elements described in above two publications are particularly suitable for use with this invention.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

The following examples illustrate the practice of the invention. They are intended to be illustrative, and should not be construed as limiting the invention to the specific embodiments disclosed.

EXAMPLES

Example 1

In accordance with the present invention, a 0.3 mol of an negative silver chloride emulsion was sensitized with an acetone solution of Compound I added at position (A) (see Diagram 1) in amounts shown in Table (1) at 40° C. This was followed by addition of a green spectral sensitizing dye (ss dye), 5-chloro-2-[2-[[5-phenyl-3-(3-sulfobutyl)-2(3H)-benzoxazolylidene]methyl]-1-butenyl]-3-(3-sulfopropyl)-benzoxazolium sodium salt (379.45 mg/Ag mol), sodium thiosulfate pentahydrate (hypo), (0.28 mg/Ag mol), a Au sensitizer, bis(1,4,5-trimethyl-1,2,4-triazolium-3-thiolate) gold (I) tetrafluoroborate, (4 mg/Ag mol), 1-(3-aceta mnidophenyl)-5-mercaptotetrazole sodium salt, Bli, in position (Ba) before the heat rise in amounts indicated in Table 1. The emulsion was heated to 60° C. at a rate of 10° C. per 6 minutes and and then held at this temperature for 40 minutes. The emulsion was cooled back to 40° C. at a rate of 10° C. per 6 minutes. Another amount of (Bli) was added at position (Bb) followed by potassium bromide (795 mg/Ag mol), and potassium chloride (10,611 mg/Ag mol). This emulsion further contained a green dye-forming coupler 7-chloro-6-(1,2-dimethylethyl)-3-[3-(dodecylsulfonyl) propyl]-1H-pyrazolo[5,1-c]-1,2,4-triazole ( 0.018 g/m$^2$) in di-n-butylphthalate coupler solvent (0.27 g/m$^2$) and gelatin (1.51 g/m$^2$).

Diagram 1.

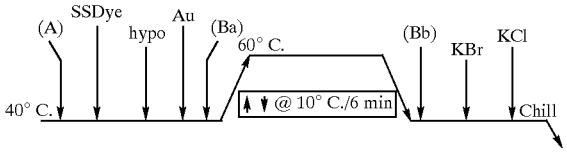

The emulsion (0.102 g Ag/m$^2$) was coated on a resin coated paper support and 1.076 g/m$^2$gel overcoat was applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tunsten lamp designed to stimulate a color negative print exposure source. This lamp had a color temperature of 3000 K, log lux 2.95, and the coatings were exposed through a combination of filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The data in Table I show the changes in fog density of the blue sensitized coatings after a two and four week storage at 120° F. relative to those kept at 0° F. Fog was measured as the minimum density (D-min) above zero. The speed taken at the 1.0 density point of the D log E curve was taken as a measure of the sensitivity of the emulsion. The wet abrasion sensitivity measurement (WAS) was made by first exposing and processing the emulsion coatings. Approximately 10 seconds into the developer, an increasing amount of mass was applied to a 0.063 inch diameter stylus that was run over the emulsion side of the photographic element. The density produced for the 30 g weight was recorded and is shown in Table I.

TABLE 1

| | (Ba) (Bb) 1 Bli mg | | | Fresh | | 2 week 120 vs 0° F. | | 4 week 120 vs 0° F. | | WAS @ 30 g |
|---|---|---|---|---|---|---|---|---|---|---|
| Sample | Ag mol | | | Spd | D-min | ΔSpd | ΔD-min | ΔSpd | ΔD-min | wt |
| 1 (comparison) | 0 | 0 | x | 182 | 0.099 | 10 | 0.024 | 11 | 0.091 | 13 |
| 2 (comparison) | 6 | 0 | x | 164 | 0.086 | 2 | 0.013 | 6 | 0.074 | 10 |
| 3 (comparison) | 8 | 0 | x | 163 | 0.094 | 5 | 0.019 | 7 | 0.086 | 7 |
| 4 (comparison) | 10 | 0 | x | 160 | 0.097 | 10 | 0.012 | 14 | 0.076 | 8 |
| 5 (comparison) | 12 | 0 | x | 135 | 0.092 | 14 | 0.013 | 28 | 0.084 | 7 |
| 6 (comparison) | 0 | 0.2x | 0.8x | 113 | 0.093 | 11 | 0.017 | 15 | 0.060 | 4 |

TABLE 1-continued

| Sample | (Ba) (Bb) 1 Bli mg Ag mol | | | Fresh Spd | Fresh D-min | 2 week 120 vs 0° F. ΔSpd | 2 week 120 vs 0° F. ΔD-min | 4 week 120 vs 0° F. ΔSpd | 4 week 120 vs 0° F. ΔD-min | WAS @ 30 g wt |
|---|---|---|---|---|---|---|---|---|---|---|
| 7 (invention) | 6 | 0.2x | 0.8x | 170 | 0.092 | 9 | 0.008 | 14 | 0.103 | 5 |
| 8 (invention) | 8 | 0.2x | 0.8x | 170 | 0.097 | 7 | 0.011 | 9 | 0.109 | 2 |
| 9 (invention) | 10 | 0.2x | 0.8x | 168 | 0.091 | 9 | 0.014 | 12 | 0.142 | 5 |
| 10 (invention) | 12 | 0.2x | 0.8x | 157 | 0.093 | 14 | 0.018 | 20 | 0.150 | 4 |
| 11 (comparison) | 0 | 0 | 0.8x | 182 | 0.093 | 7 | 0.013 | 12 | 0.117 | 11 |
| 12 (comparison) | 6 | 0 | 0.8x | 169 | 0.096 | 9 | 0.022 | 13 | 0.116 | 7 |
| 13 (comparison) | 8 | 0 | 0.8x | 164 | 0.094 | 9 | 0.027 | 15 | 0.146 | 5 |
| 14 (comparison) | 10 | 0 | 0.8x | 160 | 0.092 | 11 | 0.028 | 18 | 0.160 | 5 |
| 15 (comparison) | 12 | 0 | 0.8x | 136 | 0.092 | 19 | 0.030 | 35 | 0.161 | 6 |

x is 200 mg/Ag mol.

It can be seen in Table 1 that Samples 7–10 of the present invention, in which Bli is delivered both before and after the heat treatment and in combination with Compound 1, have good sensitivity relative to the comparison Samples 2–5 and 12–15 where Bli is delivered after the sensitization. Sample 6, where Bli is delivered both before and after the sensitization but without Compound I suffered a significant loss in speed relative the samples with Bli delivered only after the sensitization.

The WAS (the lower the number, the less the density caused by the weight exerted on the wet coating) of the inventive Samples 7–10 is lower than that of Samples (1–6) which have the normal Bli delivery at equivalent levels. For these Samples (1–6), the higher the Bli level, the lower the WAS. However, at the high levels, a loss in speed is experienced. Comparison Samples 1 and 11, without 1, show excellent speed but poor WAS.

Comparison Samples 1–5, with the full amount of Bli delivered after the finish give the smallest change in D-min; those with 80% of Bli have the biggest increase, and those with the split Bli delivery give the intermediate D-min performance.

Among the three photographic parameters considered, fresh speed, keeping D-min and WAS, there is not one group of coatings that have the best performance in all areas. Coatings with the reduced Bli level suffer from poor keeping Dmin. Coatings with the full amount of Bli delivered after the finish show significantly improved WAS only at high levels of Compound 1, which also causes speed loss. But coatings of the present invention with the split Bli delivery and with 6 or 8 mg of Compound 1 have the best combination of fresh speed, keeping D-min and improved WAS.

Example 2

In another practice of the invention, a 0.3 mole cubic negative silver chloride emulsion was similarly sensitized as in Example I except that Compound 31 was used in place of Compound 1. The emulsion was coated, and the coatings stored, exposed and processed as previously.

TABLE 2

| Sample | (Ba) (Bb) 31 Bli mg Ag mol | | | Fresh Spd | Fresh D-min | 2 week 120 vs 0° F. ΔSpd | 2 week 120 vs 0° F. ΔD-min | 4 week 120 vs 0° F. ΔSpd | 4 week 120 vs 0° F. ΔD-min | WAS @ 30 g wt |
|---|---|---|---|---|---|---|---|---|---|---|
| 16 (comparison) | 0 | 0 | X | 177 | 0.106 | 8 | 0.018 | 12 | 0.075 | 18 |
| 17 (comparison) | 2 | 0 | X | 179 | 0.103 | 2 | 0.023 | 6 | 0.104 | 12 |
| 18 (comparison) | 3 | 0 | X | 173 | 0.105 | −2 | 0.025 | 2 | 0.107 | 11 |
| 19 (comparison) | 4 | 0 | X | 145 | 0.123 | 2 | 0.039 | 5 | 0.139 | 8 |
| 20 (comparison) | 0 | 0.2X | 0.8X | 122 | 0.108 | 4 | 0.006 | 7 | 0.039 | 6 |
| 21 (invention) | 2 | 0.2X | 0.8X | 171 | 0.102 | 3 | 0.023 | 8 | 0.112 | 7 |
| 22 (invention) | 3 | 0.2X | 0.8X | 173 | 0.104 | 3 | 0.038 | 9 | 0.136 | 7 |
| 23 (invention) | 4 | 0.2X | 0.8X | 159 | 0.112 | 2 | 0.050 | 8 | 0.160 | 5 |
| 24 (comparison) | 0 | 0 | 0.8X | 180 | 0.103 | 7 | 0.015 | 13 | 0.091 | 16 |
| 25 (comparison) | 2 | 0 | 0.8X | 186 | 0.107 | 0 | 0.039 | 8 | 0.164 | 12 |
| 26 (comparison) | 3 | 0 | 0.8X | 176 | 0.107 | −4 | 0.053 | 2 | 0.163 | 11 |
| 27 (comparison) | 4 | 0 | 0.8X | 157 | 0.137 | 2 | 0.077 | 3 | 0.174 | 10 |

x is 200 mg/Ag mol.

It can be seen from Table 2 that Samples 16–19, with the full amount of Bli delivered after sensitization, have high WAS response even though the changes in D-min and speed after 2 or 4 week storage are small. At a higher level of Compound 31, (Sample 19) or with no Compound 31, but with Bli delivered both before and after the sensitization (Sample 20), there is a marked loss in speed even though the WAS performance is more acceptable.

Samples of the present invention 21–23 show the lowest WAS but still have acceptable fresh speed, and small changes on keeping. Samples with only 80% of Bli have the highest D-min increase on storage and only a minor improvement on WAS performance.

Example 3

This example provides an illustration of the benefits of the present invention in a multilayer formulation. Blue sensitive emulsion (Blue EM-1) was precipitated by adding approximately equimolar silver nitrate and sodium chloride solutions into a well-stirred reactor containing gelatin peptizer and thioether ripener. Cesium pentachloronitrosylosmate was added during the making process and potassium iodide was added towards the end of the making process to form a band of silver iodide in the grain. The resultant emulsion contained cubic shaped grains of 0.6 μm in edge length size. This emulsion was optimally sensitized by the addition of glutaryldiaminophenyldisulfide followed by the addition of a colloidal suspension of aurous sulfide, heat ramped to 60° C. during which time blue sensitizing dye, anhydro-5-chloro-3,3'-di-(3-sulfopropyl)-5'-(1-pyrrolyl)-thiazolothiacyanine hydroxide triethylammonium salt, potassium hexachloroiridate, Lippmann bromide and 1-(3-acetamidophenyl)-5-mercaptotetrazole were added.

Green sensitive emulsion (Green EM-1) was precipitated by adding approximately equimolar silver nitrate and sodium chloride solutions into a well-stirred reactor containing gelatin peptizer and thioether ripener. Cesium pentachloronitrosylosmate was added during most of the making process. The resultant emulsion contained cubic shaped grains of 0.3 μm in edge length size. This emulsion was sensitized as in Example I using the combination of compounds 1 and Bli.

Red sensitive emulsion (Red EM-1) was precipitated by adding approximately equimolar silver nitrate and sodium chloride solutions into a well-stirred reactor containing gelatin peptizer and thioether ripener. The resultant emulsion contained cubic shaped grains of 0.4 μm in edge length size. This emulsion was optimally sensitized by the addition of Bis(1,4,5-trimethyl-1,2,4-triazolium-3-thiolate) gold(I) tetrafluoroborate and sodium thiosulfate followed by heat digestion at 65° C. The following were then added, 1-(3-acetamidophenyl)-5-mercaptotetrazole, potassium hexachloroi ridate and potassium bromide. The emulsion was cooled to 40° C. and the red sensitizing dye, , anhydro-3-ethyl-9,11-neopentylene-3'-(3-sulfopropyl)-thiadicarbocyanine hydroxide, was added.

Coupler dispersions were emulsified by methods well known to the art, and the following layers were coated on a polyethylene resin coated paper support:

TABLE 3

| | |
|---|---|
| Layer 1: Blue Sensitive Layer | |
| Gelatin | 1.133 g/m$^2$ |
| Blue Sensitive Silver (Blue EM-1) | 0.186 g Ag/m$^2$ |
| Y-1 | 0.420 g/m$^2$ |
| ST-1 | 0.420 g/m$^2$ |
| Dibutyl phthalate | 0.186 g/m$^2$ |

TABLE 3-continued

| | |
|---|---|
| ST-2 | 0.010 g/m$^2$ |
| Layer 2: Interlayer | |
| Gelatin | 0.650 g/m$^2$ |
| Di-t-octyl hydroquinone | 0.056 g/m$^2$ |
| Dibutyl phthalate | 0.163 g/m$^2$ |
| Layer 3: Green Sensitive Layer | |
| Gelatin | 1.087 g/m$^2$ |
| Green Sensitive Silver (Green EM-1) | 0.067 g Ag/m$^2$ |
| M-1 | 0.280 g/m$^2$ |
| Dibutyl phthalate | 0.076 g/m$^2$ |
| Diundecyl phthalate | 0.033 g/m$^2$ |
| ST-3 | 0.019 g/m$^2$ |
| ST-4 | 0.167 g/m$^2$ |
| ST-5 | 0.530 g/m$^2$ |
| Layer 4: UV Interlayer | |
| Gelatin | 0.630 g/m$^2$ |
| UV-1 | 0.028 g/m$^2$ |
| UV-2 | 0.158 g/m$^2$ |
| Di-t-octyl hydroquinone | 0.046 g/m$^2$ |
| 1,4-Cyclohexylenedimethylene bis(2-ethylhexanoate) | 0.032 g/m$^2$ |
| Dibutyl phthalate | 0.032 g/m$^2$ |
| Layer 5: Red Sensitive Layer | |
| Gelatin | 1.300 g/m$^2$ |
| Red sensitive silver (Red EM-1) | 0.180 g Ag/m$^2$ |
| C-1 | 0.423 g/m$^2$ |
| Dibutyl phthalate | 0.415 g/m$^2$ |
| UV-2 | 0.272 g/m$^2$ |
| 2-(2-butoxyethoxy)ethyl acetate | 0.028 g/m$^2$ |
| Di-t-octyl hydroquinone | 0.003 g/m$^2$ |
| Potassium tolylthiosulfonate | 0.0023 g/m$^2$ |
| Potassium tolylsulfinate | 0.0002 g/m$^2$ |
| Layer 6: UV Overcoat | |
| Gelatin | 0.446 g/m$^2$ |
| UV-1 | 0.019 g/m$^2$ |
| UV-2 | 0.111 g/m$^2$ |
| Di-t-octyl hydroquinone | 0.033 g/m$^2$ |
| 1,4-Cyclohexylenedimethylene bis(2-ethylhexanoate) | 0.022 g/m$^2$ |
| Dibutyl phthalate | 0.022 g/m$^2$ |
| Layer 7: SOC | |
| Gelatin | 0.557 g/m$^2$ |
| Di-t-octyl hydroquinone | 0.019 g/m$^2$ |
| Silica | 0.204 g/m$^2$ |
| Polydimethylsiloxane | 0.017 g/m$^2$ |
| SF-1 | 0.002 g/m$^2$ |

The coating also included a gelatin overcoat at 1.08 g/m sq and a gelatin undercoat layer at 3.23 g/m sq. The layers were hardened with bis(vinylsulfonyl) methyl ether at 1.7% of the total gelatin weight. All materials were coated on a resin coated paper support.

TABLE 4

| | (Ba) (Bb) 1 Bli mg | | | Green | | 2 week 0 vs. 120° F. | | 4 week 0 vs. 120° F. | | WAS |
|---|---|---|---|---|---|---|---|---|---|---|
| Sample | Ag mol | | | Spd | D-min | ΔSpd | ΔD-min | ΔSpd | ΔD-min | 40 g |
| 28 (comparison) | 0 | 0 | x | 154 | 0.097 | −3.0 | 0.002 | −2.4 | 0.001 | 38 |
| 29 (comparison) | 6 | 0 | x | 142 | 0.099 | −3.7 | 0.001 | −2.7 | 0.004 | 17 |
| 30 (comparison) | 8 | 0 | x | 140 | 0.106 | −2.0 | 0.002 | −0.9 | 0.006 | 8 |
| 31 (comparison) | 10 | 0 | x | 128 | 0.1 | −1.4 | 0.004 | 5.1 | 0.007 | 7 |
| 32 (comparison) | 0 | 0.2x | 0.8x | 84 | 0.101 | −9.2 | −0.009 | −10.1 | 0.004 | 3 |
| 33 (invention) | 6 | 0.2x | 0.8x | 144 | 0.102 | −2.5 | −0.007 | −1.0 | 0.003 | 5 |
| 34 (invention) | 8 | 0.2x | 0.8x | 145 | 0.107 | −1.5 | −0.010 | −0.7 | 0.005 | 6 |

TABLE 4-continued

| Sample | (Ba) (Bb) 1 Bli mg Ag mol | | | Green Spd | Green D-min | 2 week 0 vs. 120° F. ΔSpd | 2 week 0 vs. 120° F. ΔD-min | 4 week 0 vs. 120° F. ΔSpd | 4 week 0 vs. 120° F. ΔD-min | WAS 40 g |
|---|---|---|---|---|---|---|---|---|---|---|
| 35 (invention) | 10 | 0.2x | 0.8x | 144 | 0.097 | −1.6 | 0.002 | 0.3 | 0.004 | 6 |
| 36 (comparison) | 0 | 0 | 0.8x | 155 | 0.100 | −3.1 | −0.003 | −2.8 | 0.009 | 26 |
| 37 (comparison) | 6 | 0 | 0.8x | 143 | 0.106 | −3.7 | −0.007 | −3.0 | 0.010 | 15 |
| 38 (comparison) | 8 | 0 | 0.8x | 141 | 0.109 | −2.3 | −0.011 | −1.4 | 0.012 | 11 |
| 39 (comparison) | 10 | 0 | 0.8x | 129 | 0.097 | −1.2 | −0.012 | 3.7 | 0.016 | 12 |

Table 3 tabulates the keeping and WAS data from the multilayer experiment. It can be seen that Compound I causes speed decrease for samples (28–31) with Bli delivered after the sensitization. For samples of this invention with split Bli delivery and presence of Compound 1, Samples 33–35, there is hardly any speed change. Samples with 80% of the Bli have somewhat higher D-min growth after keeping.

For WAS performance the split delivered Bli, Samples 32–35, all have good WAS response. However, Sample 32, without compound 1, suffers a marked loss in speed.

Thus the combination of split Bli and 1 provides good WAS, good keeping and fresh speed responses that either one of these technologies alone by itself would not have given the desired emulsion performance.

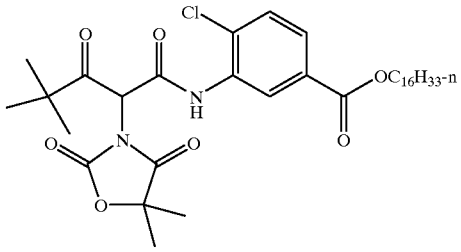

ST-1

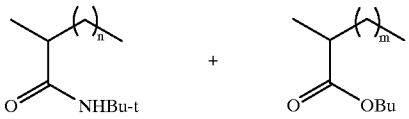

n:m 1:1 mw = 75–100,000

ST-2

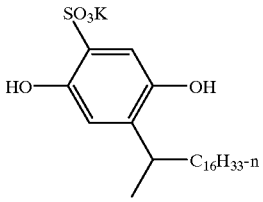

M-1

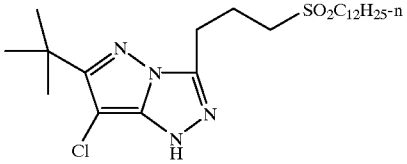

-continued

ST-3

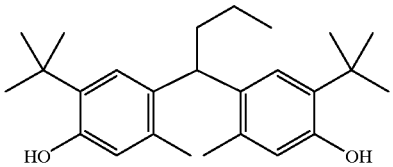

ST-4

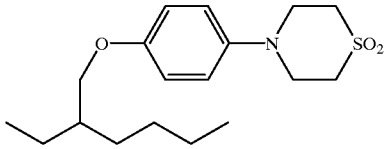

ST-5

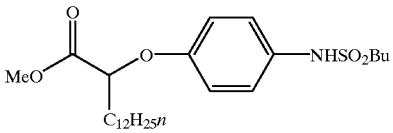

UV-1

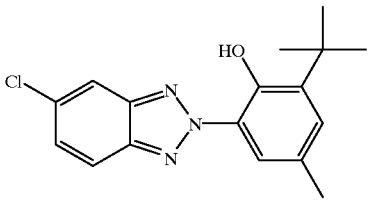

UV-2

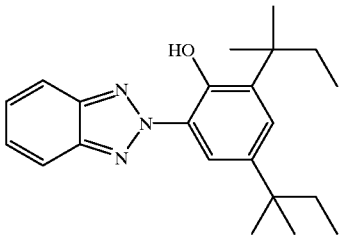

C-1

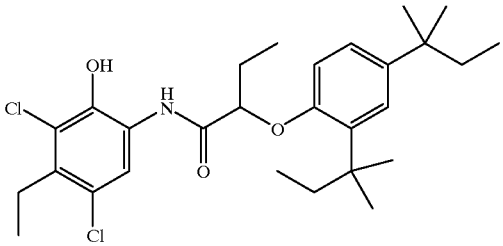

SF-1

$CF_3(CF_2)_7SO_3Na$

The invention has been described in detail with particular reference to the preferred embodiments thereof, but it will be understood that variations and modifications can be effected within the scope of the invention.

What is claimed is:

1. A method of making a silver halide emulsion having reduced wet abrasion sensitivity, the emulsion being greater than 50 mole % silver chloride, comprising a) precipitating and chemically sensitizing the emulsion;

b) adding to the emulsion either before or during the chemical sensitization a dithiolone compound represented by Formula (A):

(A)

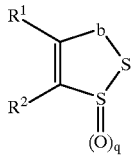

wherein b is C(O), C(S), C(Se), $CH_2$ or $(CH)_2$ and $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a substituted or unsubstituted five or six-membered ring or a multiple ring system; and q is 1 or 2; and an effective amount of a first mercapto azole compound independently represented by Formula B:

(B)

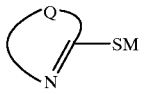

wherein Q represents the atoms necessary to form a substituted or unsubstituted five or six-membered heterocyclic ring containing at least one nitrogen atom, and M is a cation; and c) after the completion of chemical sensitization, adding to the emulsion an effective amount of a second mercapto azole compound independently represented by Formula (B).

2. The method of claim 1 wherein the dithiolone compound and the first mercapto azole compound are added during chemical sensitization of the emulsion.

3. The method of claim 1 wherein b is C(O), C(S), C(Se); and $R^1$ and $R^2$ together represent the atoms necessary to form a substituted or unsubstituted five or six-membered ring or a multiple ring system.

4. The method of claim 3 wherein $R^1$ and $R^2$ together represent the atoms necessary to form a substituted or unsubstituted five or six-membered ring and b is C(O).

5. The method of claim 4 wherein the dithiolone compound is 3H-1,2-benzodithiol-3-one 1-oxide or 3H-1,2-benzodithiol-3-one 1,1-dioxide.

6. The method of claim 1 wherein the silver halide emulsion is greater than 90 mole % silver chloride.

7. The method of claim 1 wherein Q contains the atoms necessary to form a substituted or unsubstituted tetrazole, triazole, imidazole, oxadiazole, thiadiazole or benzothiazole heterocyclic ring and wherein M is a hydrogen atom, a monovalent alkali metal cation or a tetrasubstituted ammonium cation.

8. The method of claim 7 wherein Q contains the atoms necessary to form a substituted or unsubstituted tetrazole heterocyclic ring and M is sodium.

9. The method of claim 4 wherein Q contains the atoms necessary to form a substituted or unsubstituted tetrazole heterocyclic ring and M is sodium.

10. The method of claim 5 wherein the mercapto azole compound is

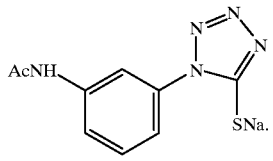

* * * * *